US005711695A

United States Patent [19]

Moran et al.

[11] Patent Number: 5,711,695

[45] Date of Patent: Jan. 27, 1998

[54] GAS-PROPELLED TOY WITH EXHAUST NOZZLE FOR GAS CARTRIDGE

[75] Inventors: Ron Moran, Pittsburg, Kans.; Robert L. Olive, Phoenix, Ariz.

[73] Assignee: Pitsco, Inc., Pittsburg, Kans.

[21] Appl. No.: 432,571

[22] Filed: May 1, 1995

[51] Int. Cl.[6] ..... A63H 29/16

[52] U.S. Cl. ..... 446/211; 446/457; 222/5; 60/200.1

[58] Field of Search ..... 446/199, 211, 446/212, 56, 163, 204, 457, 206; 239/601; 222/5; 180/7.3; 60/200.1; 124/57, 58, 60

[56] References Cited

U.S. PATENT DOCUMENTS

| | | | |
|---|---|---|---|
| 291,548 | 1/1884 | Swan | 446/204 |
| 2,545,586 | 3/1951 | Pollak | 446/56 |
| 2,588,184 | 3/1952 | Walsh | 446/212 |
| 2,637,162 | 5/1953 | Wilmot | 446/211 |
| 2,943,417 | 7/1960 | Greenspan | 446/56 |
| 3,010,444 | 11/1961 | Finnigan . | |
| 3,142,293 | 7/1964 | Harter . | |
| 3,237,343 | 3/1966 | Blanchard | 446/211 |
| 3,417,719 | 12/1968 | Nitenson | 124/57 |
| 3,572,443 | 3/1971 | Guise | 239/601 |
| 3,577,677 | 5/1971 | Bennett . | |
| 3,647,147 | 3/1972 | Cook | 239/601 |
| 3,650,214 | 3/1972 | Green . | |
| 3,659,787 | 5/1972 | Ito | 239/601 |
| 3,695,041 | 10/1972 | Eggers | 60/200.1 |
| 3,905,750 | 9/1975 | Sell | 222/5 |
| 4,150,656 | 4/1979 | Curran | 222/5 |
| 5,004,441 | 4/1991 | Hammerly et al. | 446/211 |

FOREIGN PATENT DOCUMENTS

| | | | |
|---|---|---|---|
| 1260724 | 3/1960 | France . | |
| 937632 | 1/1956 | Germany | 446/211 |
| 1199 | 6/1902 | United Kingdom | 446/206 |

OTHER PUBLICATIONS

Popular Science, Jul. 1945, p. 152.

*Primary Examiner*—Robert A. Hafer
*Assistant Examiner*—Jeffrey D. Carlson
*Attorney, Agent, or Firm*—Hovey, Williams, Timmons & Collins

[57] ABSTRACT

A gas-propelled toy comprises a vehicle body having opposed front and rear ends, a cartridge of pressurized gas carried by the vehicle body, the cartridge presents an elongated, tubular neck outlet and a frangible plug terminal adjacent to the end of the neck outlet for preventing release of gas from the cartridge, the cartridge is oriented adjacent to the rear end of the vehicle body with the neck outlet facing rearwardly, and an annular, thrust-enhancing exhaust nozzle having a sidewall disposed about the neck outlet, and an apertured end plate adjacent to and in substantial registry with the plug terminal. The aperture presents an arcuate wall, and is configured for permitting passage therethrough of a firing pin in order to pierce the plug terminal and enhancing the thrust due to the subsequent exhaust of said gas within the cartridge, in order to forwardly propel vehicle body.

9 Claims, 1 Drawing Sheet

GAS-PROPELLED TOY WITH EXHAUST NOZZLE FOR GAS CARTRIDGE

BACKGROUND OF THE INVENTION

1. Field of the Invention

The present invention relates to gas-propelled toys propelled by the propulsive force, or thrust, produced by the release of pressurized gases. More particularly, the invention concerns a removable exhaust nozzle which may be fitted to a pressurized gas cartridge for improved thrust characteristics.

2. Description of the Prior Art

Various toys are propelled by the release of gases from a pressurized gas container, such as a $CO_2$ cartridge. Examples of gas-propelled toys include airplanes, rockets, boats and dragsters.

The prior art discloses the use of a disposable pressurized gas cartridge which includes an outlet having a frangible plug terminal to prevent the gases from exiting the cartridge. The cartridge is attached to the device so that the outlet is pointed in the opposite direction of intended travel. Once the terminal is pierced by a firing pin, the cartridge releases exhaust gases through the outlet resulting in forward thrust until the cartridge is spent. The cartridge is then discarded.

Gas propelled devices generally include a cavity provided in the device which allows insertion of the cartridge into the device. The cavity also provides access to the plug terminal so that it may be readily pierced initiating use of the device.

The cartridge, however, may not be firmly seated in such a cavity. As a result, the exhaust gases often are not released in a direction which is axially aligned with the longitudinal axis of the gas-propelled toy, thereby reducing the forward thrust. Additionally, such a cavity allows the cartridge to be improperly pierced. For example, with no means of guiding the firing pin, the plug terminal may be pierced along is periphery or at an angle. Improper piercing causes misdirection of the exhaust gases, which reduces the forward thrust of the exhaust gases. The plug terminal may also be improperly pierced if the piercing means creates a relatively large hole which would result in the rapid and inefficient exhaustion of the gases.

The outlets provided in pressurized gas cartridges do not efficiently direct the flow of the exhaust gases. For example, when the plug terminal is pierced, portions of the terminal are folded into the neck outlet, causing turbulence in the flow of the exhaust gases. This turbulence results in gases which are not efficiently aligned. Therefore, a significant amount of the energy produced by the exhaust gases is lost even when the plug terminal is properly pierced.

The prior art also discloses a pressurized gas container that is included as an integral component of the gas propelled device. For instance, U.S. Pat. No. 3,010,444 discloses an aerial toy device which includes a refillable pressurized gas container having an electrically actuated means for initiating the release of gas. While such containers are refillable, and, therefore, reusable, they are also relatively difficult and expensive to construct. Therefore, the prior art presents a significant and heretofore unsolved need to provide an economically efficient means of directing the flow of gases being exhausted by a pressurized gas cartridge for increasing the thrust produced by the gases.

SUMMARY OF THE INVENTION

The present invention solves the prior art problems discussed above and provides a distinct advance in the state of the art. More particularly, the gas-propelled toy hereof includes an economical and efficient way to direct gas exhaust for producing maximum thrust.

The preferred gas-propelled toy broadly includes a wheeled vehicle body, a cartridge of pressurized gas carried by the body, and an annular, thrust-enhancing exhaust nozzle. The vehicle body includes opposed front and rear ends, and a cartridge carrying cavity provided in the rear end.

The cartridge presents an elongated, tubular neck outlet and a frangible plug terminal adjacent to the end of the neck outlet. The plug terminal prevents the release of the gases from the cartridge. Once the plug terminal is pierced, the pressurized gas is released through the neck outlet creating thrust until the cartridge is spent.

The cartridge is inserted into the cavity of the vehicle body so that the neck outlet faces rearwardly relative to the vehicle body. Therefore, the thrust created by the exiting gases propels the vehicle body forward.

The annular, thrust enhancing exhaust nozzle includes a sidewall and an end plate having an inner face and an outer face. The end plate includes an arcuate wall which defines an aperture. The aperture diverges from the inner face to the outer face. Once the cartridge is inserted into the cavity, the nozzle may be seated on the neck outlet of the cartridge so that the nozzle sidewall is disposed about the neck outlet, and the aperture is adjacent to and in substantial registry with the plug terminal.

The aperture is configured for permitting the passage of a firing pin in order to pierce the plug terminal, aligning the firing pin and enhancing the subsequent exhaust of the gas from the cartridge through the outlet, in order to forwardly propel the vehicle body. The nozzle also forcibly aligns the pressurized gas cartridge into alignment with the longitudinal axis of the gas-propelled toy.

DETAILED DESCRIPTION OF THE PREFERRED EMBODIMENT

Figures 1, 2, 3, 4, 5, 6:
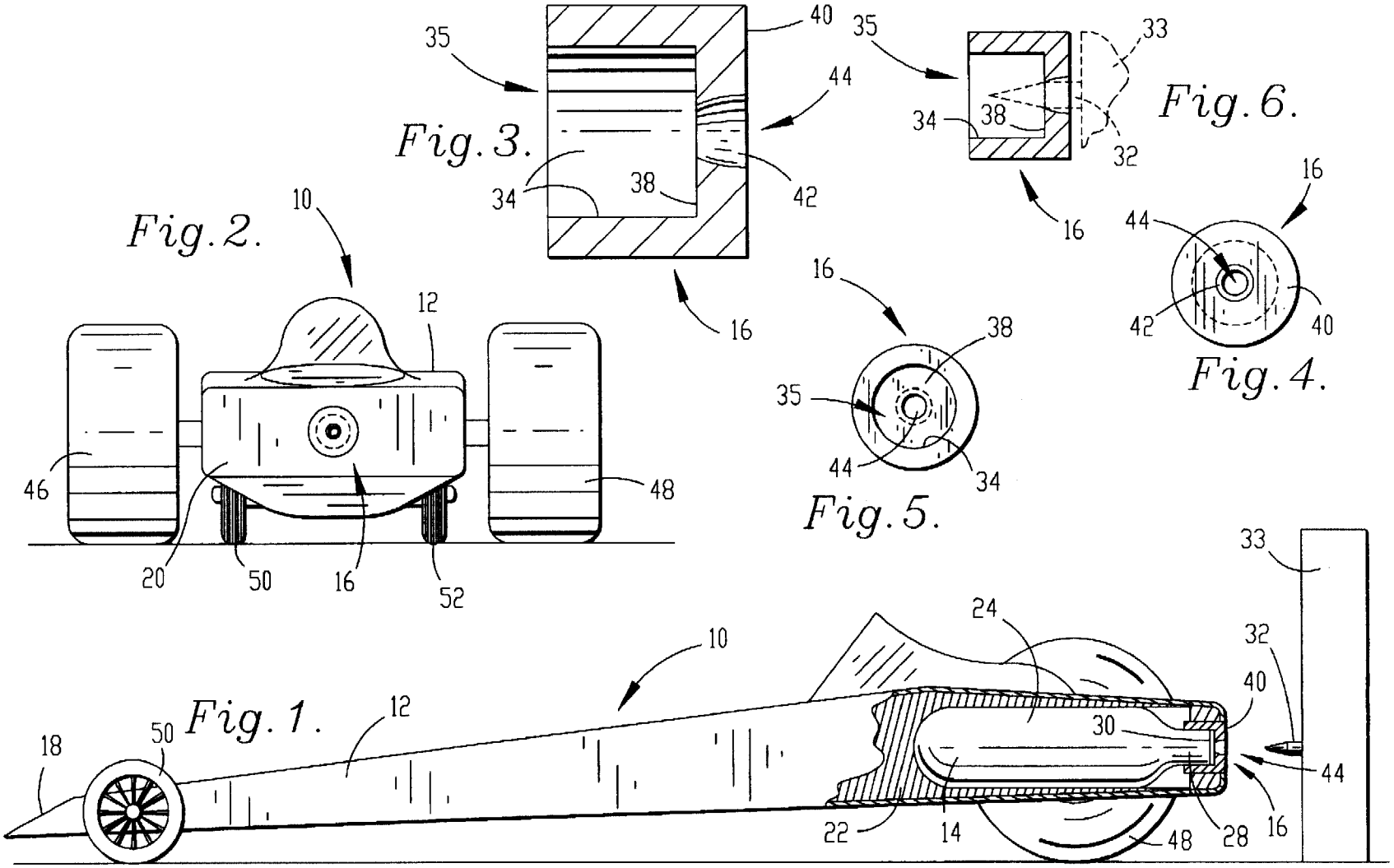
FIG. 1 is an elevational view of the preferred gas-propelled toy shown in partial section with the rear of the toy adjacent a wall presenting a firing pin.
FIG. 2 is a rear view of the toy of FIG. 1.
FIG. 3 is a side sectional view of the preferred gas exhaust nozzle of the toy of FIG. 1.
FIG. 4 is rear view of the exhaust nozzle of FIG. 3.
FIG. 5 is front end view of the exhaust nozzle of FIG. 3.
FIG. 6 is a side sectional view of the preferred gas exhaust nozzle of the toy of FIG. 3, depicting a firing pin in dashed lines extending through the aperture.

Referring now to FIG. 1, gas-propelled toy 10 broadly includes vehicle body 12, cartridge 14 of pressurized gas carried by the body, and annular, thrust-enhancing exhaust nozzle 16. Vehicle body 12 includes opposed front and rear ends 18 and 20. Cartridge carrying cavity 22 is provided in rear end 20 of vehicle body 12.

Cartridge 14 includes hollow main portion 24 having generally cylindrical outer surface 26, elongated tubular neck outlet 28 and frangible plug terminal 30 adjacent to the end of neck outlet 28. Pressurized gas, such as $CO_2$ gas, is stored in cartridge 14. Cartridge 14 may be constructed of metallic material, synthetic resin material, or other material that is suitable for containing the pressurized gas without explosion.

Plug terminal 30 prevents the release of the gas from cartridge 14. Plug terminal 30 may be pierced by firing pin 32. FIG. 1 discloses firing pin 32 mounted to stationary blast wall 33, however, firing pin 32 may be mounted to a moveable support, such as a board, or, alternatively, firing pin 32 may be unattached. Once plug terminal 30 is pierced, the pressurized gas exits cartridge 14 through neck outlet 28 resulting in the creation of thrust.

Cartridge 14 is carried by vehicle body 12 so that neck outlet 28 faces rearwardly relative to body 12. Piercing plug terminal 30 results in release of the exhaust gases in a direction which is generally axially aligned with the longitudinal axis of toy 10. Therefore, the thrust created by the release of the exhaust gases propels toy 10 forward.

Referring now to FIGS. 3–5, annular, thrust enhancing exhaust nozzle 16 includes sidewall 34 and apertured end plate 36 with inner face 38 and outer face 40. Sidewall 34 defines neck outlet receiving portion 35 having a generally uniform diameter. The diameter of sidewall 34 is substantially the same as the exterior diameter of neck outlet 28. Therefore, nozzle 16 may be frictionally fitted onto cartridge 14 by placing receiving portion 35 over neck outlet 28. Nozzle 16 may be constructed of metallic material, synthetic resin material, or other suitable material. Additionally, nozzle 16 may be machined, or molded.

End plate 36 includes arcuate wall 42. Arcuate wall 42 defines aperture 44 which diverges from inner face 38 to outer face 40. The diameter of aperture 44 at a point adjacent to inner face 38 is substantially the same as the diameter of firing pin 32. It will be appreciated that this prevents the pressurized gas in cartridge 14 from escaping until firing pin 32 has been removed from neck outlet 28, thereby maximizing the available thrust.

Preferably, the diameter of aperture 44 is between about 0.05"–0.25". For example, the diameter of aperture 44 at a point adjacent to inner face 38 may be approximately 0.10", and the diameter of aperture 44 at a point adjacent to outer face 40 may be approximately 0.146". When aperture 44 has such dimensions, arcuate wall 42 forms an arc of a circle having a radius of about 0.248". This radius is depicted in FIG. 3. The dimensions of aperture 44 as previously stated may be changed so that nozzle 16 may be used with cartridges of differing sizes. Additionally, arcuate wall 42 may form an arc of various geometric shapes, such as an ellipse, a parabola, or a hyperbola.

Arcuate wall 42 of aperture 44 is configured so that the tangential line of arcuate wall 42 at a point adjacent to outer face 40 is axially aligned with the longitudinal axis of nozzle 16, and thus toy 10 when nozzle 16 is attached to toy 10. Arcuate wall 42, therefore, enhances the thrust resulting from the exhaust of the gas from cartridge 14 through outlet 28 by redirecting non-aligned exhaust gases into axial alignment with the longitudinal axis of toy 10.

FIG. 1 depicts cartridge 14 inserted into cavity 22 of vehicle body 12 with nozzle 16 seated on neck outlet 28 of cartridge 14 so that sidewall 34 is disposed about neck outlet 28. Aperture 44 of end plate 36 is adjacent to and in substantial registry with plug terminal 30. It will be appreciated that by seating nozzle 16 on neck outlet 28, cartridge 14 is necessarily aligned with the longitudinal axis of toy 10.

In operation, toy 10 is prepared for use by inserting cartridge 14 into cavity 22 of vehicle body 12 and seating nozzle 16 on cartridge 14. Receiving portion 35 of nozzle 16 frictionally fits nozzle 16 onto cartridge 14. When frangible plug terminal 30 is pierced by firing pin 32, the pressurized gas begins to exit cartridge 14 resulting in forward thrust, and thus forward motion of vehicle body 12.

It will be appreciated that nozzle 16 protects cartridge 14 from improper piercing while increasing the thrust produced by the exhaust gases. For example, by seating nozzle 16 on neck outlet 28 of cartridge 14, the exposed area of plug terminal 30 is reduced. Additionally, by providing exhaust nozzle 16 including aperture 44 having approximately the same size as firing pin 32, firing pin 32 will be forcibly properly positioned when piercing plug terminal 30.

Improper piercing may occur when plug terminal 30 is pierced along its periphery, or if firing pin 32 is too large, resulting in a large hole through plug terminal 30, and inefficient exhaustion of the pressurized gases. Proper placement of firing pin 32 as well as proper sizing of the hole pierced by firing pin 32 in plug terminal 30 maximizes the efficiency of neck outlet 28, and thus cartridge 14.

Once plug terminal 30 has been pierced, arcuate wall 42 of nozzle 16 directs the exhaust gases into axial alignment with the longitudinal axis of toy 10. Such redirection of the exhaust gases maximizes the forward thrust. After cartridge 14 is spent, nozzle 16 may be removed so that cartridge 14 may be disposed. Nozzle 16 is saved for reuse.

Toy 10 may be any of a plurality of types of gas-propelled toys. For example, toy 10 of the illustrated preferred embodiment is a surface engaging toy having surface engaging wheels 46, 48, 50 and 52 provided adjacent to vehicle body 12. Surface engaging wheels 46, 48, 50 and 52 allow toy 10 to be propelled along a horizontal plane relative to the ground, or along a plane which is inclined relative to the ground.

Toy 10 may also be a water craft toy by providing a floatable vehicle body. Such a device may be used on a body of water, such as a pool, pond, river, lake, or ocean.

Alternatively, toy 10 may be an aerial toy, such as an airplane or rocket. For example, providing lift producing airfoils, such as wings, would allow the device to be propelled in flight by the exhaust gases. Use of exhaust nozzle 16 increases the flight speed of the airplane-type aerial toy, and thus the distance flown. Once cartridge 14 is spent, the airplane toy would glide back to the ground for recovery.

A rocket-type aerial toy would provide a cylindrical vehicle body having fins along rear end 20 for stabilized flight and a deployable parachute. The rocket toy could then be launched into the air by piercing plug terminal 30. Once cartridge 14 is spent, the parachute would deploy, and the rocket toy would then float back to the ground for recovery. Exhaust nozzle 16 would increase the in-flight speed of the rocket toy, and, thus, the altitude reached at the pinnacle of its flight.

Although toy 10 and nozzle 16 have been described with reference to the illustrated preferred embodiment, it is noted that variations and changes may be made and equivalents employed herein without departing from the scope of the invention as recited in the claims. For example, sidewall 34 of nozzle 16 of the illustrated preferred embodiment defines neck outlet receiving portion 35 having a substantially uniform diameter which may be frictionally fitted to neck outlet 28. Those skilled in the art will appreciate that sidewall 34 may alternatively have any of a plurality of shapes and sizes.

Sidewall 34 may be sloped or stepped, so that the diameter of receiving portion 35 decreases towards inner face 38. When sidewall 34 is slopped, receiving portion 35 is uniformly tapered, thereby allowing nozzle 16 to be frictionally fitted to various cartridges having neck outlets with varying shapes and sizes. Providing a stepped sidewall would also allow nozzle 16 to be fitted to cartridges having neck outlets with various shapes and sizes. Although the stepped sidewall could not be fitted to neck outlets having as many shapes and sizes as the sloped sidewall, the area of contact would be increased between neck outlet 28 and the stepped sidewall compared with a tapered receiving portion of the sloped sidewall, thereby yielding a relatively preferable frictional fit.

Various internal features may be provided to improve the fit of the nozzle on neck outlet 28. For instance, sidewall 34 may include a transverse groove for receiving an o-ring. By providing an o-ring in sidewall 34, the frictional fit between nozzle 16 and neck outlet 28 would be improved. Providing a ribbed sidewall would also improve the frictional fit of nozzle 16 onto cartridge 14. The methods involved in manufacturing such nozzles, and especially the addition of an o-ring, would undesirably increase the cost of manufacturing the nozzle compared with nozzle 16 of the preferred embodiment.

Another internal feature which may be utilized to improve the fit of nozzle 16 on neck outlet 28 includes internal threads provided on sidewall 34. An internally threaded nozzle would thus receive an externally threaded neck outlet. Again, such a feature would have the undesirable effect of increasing the costs of manufacturing nozzle 16.

We claim:

1. A gas-propelled toy, comprising:

a vehicle body having opposed front and rear ends;

a cartridge of pressurized gas carried by said body, said cartridge presenting an elongated, tubular neck outlet and a frangible plug terminal adjacent the end of said neck outlet for preventing release of gas from said cartridge;

said cartridge being oriented adjacent the rear end of said toy body with said neck outlet facing rearwardly; and an annular, thrust-enhancing exhaust nozzle having a sidewall disposed about said neck outlet, and an end plate, said end plate having an arcuate wall defining an aperture, said aperture adjacent to and in substantial registry with said plug terminal, said aperture configured for permitting passage therethrough of a firing pin in order to pierce said plug terminal, and for subsequent exhaust therethrough of said gas within the cartridge upon release of said toy, in order to forwardly propel said toy, and said end plate being in contact with said plug terminal.

2. The toy of claim 1, said nozzle sidewall being in contact with said neck outlet.

3. The toy of claim 1, said end plate having an inner face adjacent said plug terminal and an opposed outer face, said aperture diverging from said inner to said outer face.

4. The toy of claim 3, said nozzle having a longitudinal axis, said arcuate wall defining an arc of a circle, the line tangent to said arcuate wall at said outer face being axially aligned with said longitudinal axis of said nozzle.

5. The toy of claim 3, the diameter of said aperture at said inner face being from about 0.05"–0.25".

6. The toy of claim 3, the diameter of said aperture at said inner face being about 0.10".

7. The toy of claim 6, said arcuate wall defining an arc of a circle having a radius of about 0.248".

8. The toy of claim 1, said toy being a surface engaging vehicle, said body including surface-engaging wheels.

9. The toy of claim 1, the thickness of said end plate being from about 0.05"–0.25".

* * * * *